United States Patent [19]

Drullinger

[11] Patent Number: 4,558,218

[45] Date of Patent: Dec. 10, 1985

[54] HEAT PIPE OVEN MOLECULAR BEAM SOURCE

[75] Inventor: Robert E. Drullinger, Boulder, Colo.

[73] Assignee: The United States of America as represented by the Secretary of Commerce, Washington, D.C.

[21] Appl. No.: 636,769

[22] Filed: Aug. 1, 1984

[51] Int. Cl.[4] ..... H05H 3/02

[52] U.S. Cl. ..... 250/251; 219/274

[58] Field of Search ..... 250/251; 219/274; 239/135, 136

[56] References Cited

U.S. PATENT DOCUMENTS 3,058,023 10/1962 George ..... 250/251

OTHER PUBLICATIONS

Swenumson et al., "Continuous Flow Reflux Oven . . . ", *Rev. Sci. Instrum.,* 52 (4), Apr. 1981, pp. 559–561.

*Primary Examiner*—Alfred E. Smith
*Assistant Examiner*—Jack I. Berman
*Attorney, Agent, or Firm*—Eugene J. Pawlikowski; Alvin J. Englert; Kirk M. Hudson

[57] ABSTRACT

A heat pipe oven molecular beam source wherein a hollow porous metal, metalloid or ceramic body with at least one opening is nearly saturated with the working material and heated to just above the melting point of the working material, generating a thin liquid layer of the working material on the internal surface of the body. Material passing the length of the bore of the body without striking a wall will escape and form the beam. Material striking the liquid layer covering the inside of the body will condense and be conveyed by capillary action back to the closed end of the body.

18 Claims, 6 Drawing Figures

HEAT PIPE OVEN MOLECULAR BEAM SOURCE

BACKGROUND OF THE INVENTION

Atomic and molecular beam machines are powerful, widely used devices in the laboratory study of atomic and molecular properties, but they also find practical application in devices such as portable atomic frequency and time standards. In this latter application, they are integral parts of precision navigation systems and frequently are used in highly dynamic or space environments. As the discussion throughout this application applies equally to most atomic and molecular materials from which one might form a beam, the two terms ("atom" and "molecule") will be used interchangeably throughout.

FIGS. 4 and 5 represent well known prior art ovens. FIG. 4 shows the type of stable oven that would be used in a laboratory beam machine which does not need to operate over a long time period. The working material is contained in a heated chamber A and some of the vapors are allowed to escape through a small hole. The expanding cloud of vapor is intercepted by a collimator B which allows atoms with the correct trajectory to pass down the beam line. The total amount of material emitted through the oven hole can be shown to be:

$$Q_o = \tfrac{1}{4} n v A_s$$

where n is the number density of atoms or molecules in the oven chamber, v is their mean thermal velocity and $A_s$ is the area of the source hole. If the collimator hole can be characterized by a radius, r, separated from the oven hole by a distance, L, then the material emitted into the beam can be shown to be:

$$Q_b = Q_o\left(\frac{r}{L}\right)^2$$

Thus, if L is very much larger than r, the effect of the collimator is substantially to reduce the total amount of material injected into the beam machine without affecting the onaxis beam flux.

The problem with this oven is the excessive amount of material which leaves the oven chamber but does not contribute to the beam. This material must be trapped behind the collimator. It cannot be allowed to find its way into the beam area or to plug the collimator.

The oven shown in FIG. 5 was developed in an attempt to deal with this problem. The working material is contained in a heated chamber C and some of the vapors allowed to expand into a second chamber D at a slightly higher temperature. From here vapors pass through a multi-channel array E and into the beam chamber. The process of passing through the multichannel array creates a quasi-collimated beam. The tubes of the collimator array are "bright wall" tubes, that is, any atom or molecule which strikes the wall of the tube must subsequently reevaporate and come back off the wall. Most of the atoms which enter a collimator tube return to the oven, while a smaller number travel the length of the tube and exit as part of the collimated beam. The effect of the "bright walled" tube collimator is to leave the forward directed flux unchanged, but to reduce the total amount of material leaving the oven to:

$$Q_b = Q_o\left(\frac{8r}{3L}\right)$$

ps where r is the tube radius and L is its length.

While this device in part solves the excessive emission problem of the oven shown in FIG. 4, it suffers from several problems of its own. The collimation effect for a given aspect ratio (collimator hole area to length) has been reduced from $$\left(\frac{L}{r}\right)^2$$

in the oven of FIG. 4, to $$\frac{3L}{8r},$$

resulting in an increase in the amount of non-useful material injected into the beam area, material which can have long-term detrimental effects. The oven also requires structures to provide anti-spill functions when used in a non-laboratory application, and, with some materials, particularly those of interest to time standards, the small holes of the multichannel array have shown some tendency periodically to plug and unplug, giving rise to a spatially non-uniform and unstable beam.

A third, considerably more complicated, device is disclosed in R. D. Swenumson and U. Even, "Continuous Flow Reflux Oven as the Source of an Effusive Molecular Cs Beam," Rev. Sci. Instrum., 52(4):559–561 (April 1981). This device uses a series of baffles to provide the collimation effect and a steel mesh to provide capillary action to return excess material caught by the baffles to the oven chamber. Its disadvantages include its complexity, and its sensitivity to orientation and acceleration. In addition, its baffles and collimators are susceptible to condensate induced changes in beam shape and even plugging in the absence of gravity.

SUMMARY OF THE INVENTION

To deal with these problems we have developed a new oven beam source based on a porous wicking structure which takes advantage of a unique aspect to the oven of FIG. 4. The operation of a single hole oven followed by a single hole collimator as shown in FIG. 4 is unaffected by the shape of the chamber between the source and the collimator hole so long as that chamber removes all non-beam atoms. In fact, the hole in the oven and the collimator hole would be the two ends of a straight tube if the chamber's interior walls looked like a "black hole" to any atom which struck them, i.e., if any material skimmed by the chamber walls did not return to the vapor phase and did not build up on the walls changing the shape of the chamber. Such a device can be achieved using a pipe oven of porous wicking substrate nearly saturated with the working material and operated at a temperature just above the melting point of that material.

The source of the present invention is a pipe oven the walls of which are made of a porous substrate (which as used herein means the body of the oven) which is nearly saturated with the source material for the beam. The pipe oven is heated to just above the melting point of the source material. Capillary wetting action then causes a thin layer of the liquid source material to develop on the oven surfaces. If the temperature of the source end of the pipe cylinder is raised so that the source material begins to evaporate, vapor fills the central cavity and expands toward the output end (collimator) of the tube.

Since the inner wall of the pipe oven is coated with a thin liquid layer of the source material, when an atom strikes the wall, it actually strikes a surface of its own liquid near its melting point. For most materials these conditions will result in sticking collisions. In particular, metal atoms will not bounce off their own liquid.

As material is evaporated from the hot zone and condensed in the cool collimating zone, capillary forces will act to move the condensate into the walls of the collimator and back to the evaporator region. Hence, the porous tube collimator is acting as a "black walled" collimator and as such obeys the analysis for ovens of the type discussed above in connection with FIG. 4, i.e., $$Q_b = Q_o\left(\frac{r}{L}\right)^2.$$

The source material saturating the pipe oven constitutes the reservoir of source material for the device. Since this means that no pool of source material exists in the device and as capillary action is insensitive to position and acceleration (gravitation), the beam source as a whole is insensitive to orientation and acceleration.

In addition to the interior walls of the collimator bore, the exposed front surface of the collimator is coated with working material. Although at a comparatively low temperature, this front surface will emit some non-collimated flux into the beam machine. In a small number of highly sensitive or low flux applications, this extraneous emission may be undesirable. Two design techniques which all but eliminate this emission are available.

First, as shown in FIG. 3, the exposed front surface of the saturated wicking material can be made arbitrarily small, either by tapering the collimator wall to nearly negligible thickness at the output end, or simply by using a very thin collimator wall. In either case, the corresponding loss of reservoir volume can be made up by the addition of extra porous material in the hot evaporator region.

Second, the porosity of the substrate may be varied over the length of the pipe oven. The vapor pressure of material contained in capillary structures can be significantly reduced from that of the bulk material. This reduction is a function of the shape of the meniscus formed as a result of the wetting action of the working material on the wicking structure. Hence, by selecting the appropriate pore size and wicking substrate, one can control this potential source of undesirable emission. With smaller capillary channels and a more strongly wetted wicking substrate, the vapor pressure can be depressed. Conversely, in the evaporator region, the use of large pore, weakly wetted substrate can increase the vapor pressure of the working substance to near its bulk material value. Inasmuch as the emission of source material from the walls of the collimator is such that the device output hole appears to emit material at the same rate as the saturated wicking substrate around it, adjusting the porosity in this fashion effectively adjusts the rate at which the material is emitted.

As is apparent, the result is a device of extreme simplicity which readily may be altered to provide beams of varying sizes and shapes simply by altering the relative dimensions of the bore of the device. The complexity and position and acceleration sensitivities of the prior art devices are effectively eliminated.

BRIEF DESCRIPTION OF THE DRAWINGS

The following drawings, in which like letters and numbers refer to like elements, are used in describing, without limitation, the claimed invention:

FIG. 1(*b*) is a graph representing the temperature of the embodiment shown in FIG. 1(*a*) at different points along its length.

DETAILED DESCRIPTION

Figure 1A:
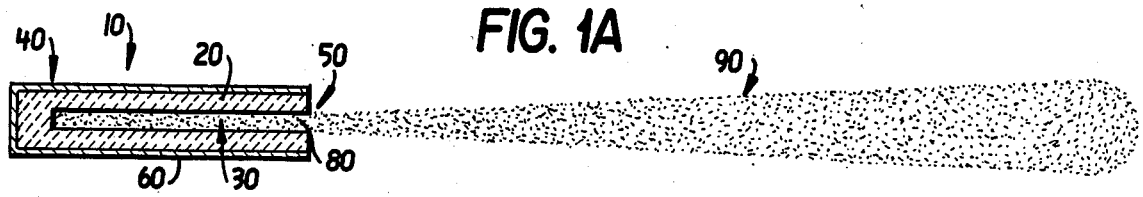
FIG. 1(*a*) is a cross-sectional view of a preferred embodiment of the present invention.
Figure 1B:
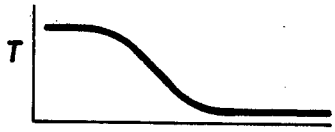

In FIG. 1(*a*), a heat pipe oven molecular beam source 10 is constructed of a porous wicking substrate 20. The substrate 20 has a central cavity or bore 30 formed therein and extending from a closed source end 40 to an open output end 50. The exterior of said substrate 20 exclusive of said output end 50 should be non-porous or, alternatively, should be enclosed by a relatively non-porous casing 60, as shown.

The substrate 20 is nearly saturated with the source material for the beam. The source material may be any suitable substance of which a beam of material is desired, including, but not limited to, Cesium and other metals and alkali metals and suitable organic compounds, such as formaldehyde. Conventional heat means (not shown), such as external resistive coils or resistive self-heating, are provided to maintain the temperature of the oven 10 slightly above the melting point of the source material. Capillary wetting action then develops a thin liquid layer 70 of the source material over the entire surface of central bore 30, as best seen in FIG. 2.

To generate a beam, the temperature at the source end 40 of oven 10 is raised somewhat above the melting point of the source material, thereby causing increased evaporation of the source materials from the liquid layer 70. Meanwhile, the temperature close to the output end 50 of oven 10 is maintained only slightly above the melting point of the source material, as indicated in the graph in FIG. 1(*b*), wherein the vertical axis represents the temperature of oven 10 and the horizontal axis represents the position along the bore 30 of oven 10.

Figure 2:
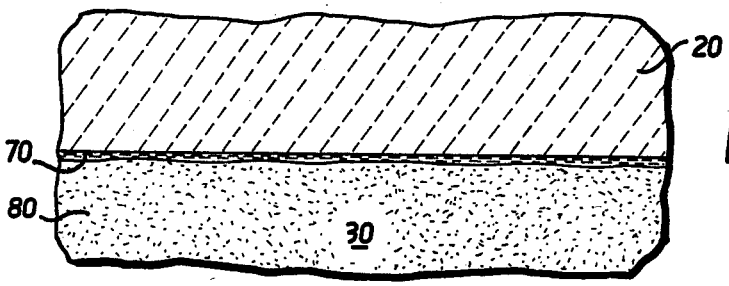
FIG. 2 is a cross-sectional detail of the surface of the central bore of the embodiment shown in FIG. 1(*a*).

As indicated in FIG. 1(*a*), but best seen in FIG. 2, the heating of the oven at the source end 40 causes the source material to go into a vapor form 80. A portion of this vapor will subsequently comprise the beam 90. In particular, only that portion of the vapor 80 which passes from its evaporation point along the bore 30 without striking the liquid layer 70 will pass through the output end 50 and become a portion of the beam 90. Any of the material 80 which strikes the liquid layer 70 will condense and be drawn back into the substrate 20 by capillary action.

This same capillary action serves to distribute evenly the source material throughout the substrate 20. In addition, the porous substrate 20 acts as a reservoir of the source material by storing it in the pores of substrate 20.

Figure 3:
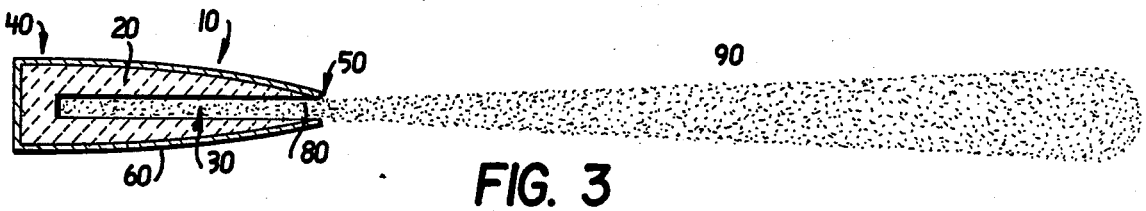
FIG. 3 is another preferred embodiment of the present invention.
Figure 4:
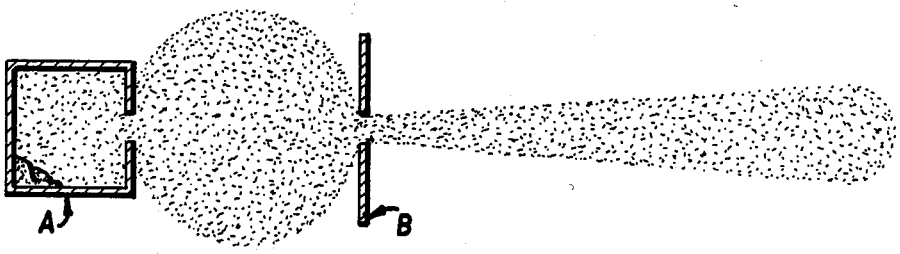
FIG. 4 (PRIOR ART)
FIG. 4 is a first prior art beam source.
Figure 5:
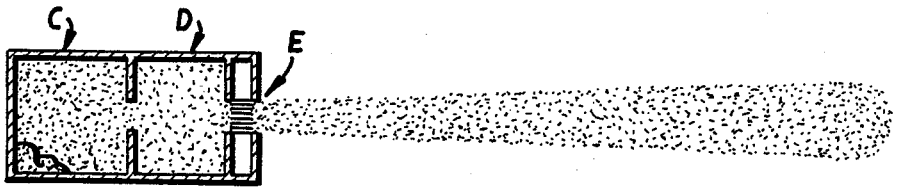
FIG. 5 (PRIOR ART)
FIG. 5 is a second prior art beam source.

The output end 50 is left uncovered to prevent the undesired accumulation of source material on the casing 60. In very low flux or high sensitivity situations where the small amount of non-collimated flux from the uncased output end 50 is unacceptable, the output end 50 may be tapered to reduce this effect, as shown in FIG. 3.

One of the consequences of such tapering is the loss of the reservoir capacity represented by the substrate 20 which has been removed to form the taper. This loss may be compensated for by adding more substrate material (and hence more reservoir capacity) at the source end 40 of the oven 10, also shown in FIG. 3.

The substrate itself may be comprised of any suitably porous materials, the only limiting criterion being that the working material must wet, but not otherwise chemically react with, the substrate. Substrates have been formed of various sintered metals, including tungsten, molybdenum and stainless steel. Depending on the working material, suitably porous metals, including nickel and copper in addition to those already listed, should also form suitable substrates, as should various alumina silicates for non-metallic working materials. A water beam source has been constructed using cloth gauze as the substrate.

In forming the substrate, it is crucial that the surface of the central bore remain porous. Simply drilling a bore into a block of substrate may tend to smear the substrate and close the pores on the surface of the bore. The bore must then be chemically etched to re-open the pores. Suitable pre-bored substrates are available commercially from Spectra-Mat Inc. of Watsonville, Calif.

A specific example is provided for illustrative purposes only: a pre-bored sintered tungsten substrate obtained from Spectra-Mat Inc. was nearly saturated with Cesium, which has a melting point of 28.4° C. A beam was produced by heating the output end 50 of the device to 30° C. and the source end 40 to varying temperatures between 80° and 120° C. As would be expected, the total beam flux increased as the source and temperature increased.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limiting the scope and spirit of the invention as set forth in the appended claims.

We claim:

1. A molecular beam source comprising:

a porous substrate having a constant diameter central cavity with at least one opening to the exterior of the substrate;

working material nearly saturating said substrate such that a thin liquid layer of said working material covers the surface of the central cavity; and means for maintaining the temperature of said substrate slightly above the melting point of said working material.

2. The molecular beam source of claim 1, wherein said central cavity comprises an axial bore with two ends, the first end being closed and the second end being open.

3. The molecular beam source of claim 1, wherein the temperature means is disposed such that the temperature of said substrate away from said at least one opening is maintained at a temperature higher than the temperature of said substrate near said at least one opening.

4. The molecular beam source of claim 1, wherein said substrate is thicker away from said at least one opening than near said at least one opening.

5. The molecular beam source of claim 1, wherein the pores of said porous substrate are larger away from said at least one opening than near said at least one opening.

6. The molecular beam source of claim 1, wherein said substrate is selected from the group consisting of tungsten, molybdenum, stainless steel, nickel, copper and the alumina silicates.

7. The molecular beam source of claim 1, wherein said working material is cesium, said substrate is sintered tungsten, and said temperature means is disposed such that the temperature of said substrate near said single opening is maintained at about 30° C. and the temperature of said substrate away from said single opening is maintained between about 80° and 120° C.

8. The molecular beam source of claim 2, wherein the axial length of said bore is substantially greater than its diameter.

9. A molecular beam source comprising:

a porous wick with a non-porous external casing, said wick having a constant diameter axial bore extending from a first end of said wick to a second end of said wick;

an opening at said second end opening said bore to the exterior of said wick and casing;

source material nearly saturating said wick;

a heat source for maintaining the temperature of said source material above its melting point.

10. The molecular beam source of claim 9, wherein said heat source is so disposed as to maintain the temperature of said second end just above said melting point, while maintaining the temperature of said first end further above said melting point.

11. The molecular beam source of claim 9, wherein the external diameter of said wick tapers from said first end to said second end.

12. The molecular beam source of claim 9, wherein the pores of said wick are larger at said first end than at said second end.

13. The molecular beam source of claim 9, wherein said source material is a metal, alkali metal, organic compound or water.

14. The molecular beam source of claim 9, wherein said wick is selected from the group consisting of sintered tungsten, sintered molybdenum, sintered stainless steel and cloth gauze.

15. The process of generating a molecular beam, comprising:

providing a porous substrate having a constant diameter central axial bore, said bore being closed at one end and open at the other with the exterior of said substrate in a non-porous casing;

nearly saturating said substrate with the material of which the beam is to be comprised;

maintaining the temperature of said substrate and said material slightly above the melting point of said material.

16. The process of claim 15, further comprising:

raising the temperature of said substrate and said material at said closed end further above said melting point, while maintaining the temperature at said open end slightly above said melting point.

17. The process of claim 15, wherein said porous substrate is provided by drilling said axial bore into a block of the material of which said substrate is comprised; and etching the surface of the bore to re-open the pores therein.

18. The process of claim 17, further comprising:

shaping the outside of said block such that it tapers from said closed end to said open end.

* * * * *